US011970252B1

(12) United States Patent
Waldvogel et al.

(10) Patent No.: US 11,970,252 B1
(45) Date of Patent: Apr. 30, 2024

(54) SYSTEMS AND METHODS FOR CONTROLLING POWER GENERATION AND TRANSMISSION OUTPUT SPEED FOR MARINE PROPULSION DEVICES

(71) Applicant: Brunswick Corporation, Mettawa, IL (US)

(72) Inventors: David J. Waldvogel, Fond du Lac, WI (US); Brett Bielefeld, Fond du Lac, WI (US); David J. Belter, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 18/303,356

(22) Filed: Apr. 19, 2023

Related U.S. Application Data

(62) Division of application No. 16/991,105, filed on Aug. 12, 2020, now Pat. No. 11,691,702.

(51) Int. Cl.

| | |
|---|---|
| ***F01D 1/00*** | (2006.01) |
| ***B63B 79/40*** | (2020.01) |
| ***B63H 21/21*** | (2006.01) |
| ***B63H 23/30*** | (2006.01) |

(52) U.S. Cl.
CPC ..... *B63B 79/40* (2020.01); *B63H 21/21* (2013.01); *B63H 23/30* (2013.01)

(58) Field of Classification Search
CPC ..... B63B 79/40; B63H 21/21
See application file for complete search history.

(56) References Cited

U.S. PATENT DOCUMENTS

| | | | | |
|---|---|---|---|---|
| 6,176,750 | B1 | 1/2001 | Alexander et al. | |
| 6,342,775 | B1 | 1/2002 | Sleder, Sr. | |
| 6,652,330 | B1 | 11/2003 | Wasilewski | |
| 6,857,917 | B1 | 2/2005 | Wasilewski | |
| 7,812,467 | B1 | 10/2010 | Lemancik et al. | |
| 8,439,800 | B1 | 5/2013 | Bazan et al. | |
| 9,441,724 | B1 | 9/2016 | Pugh | |
| 9,975,619 | B1 | 5/2018 | Gonring | |
| 11,215,128 | B1 * | 1/2022 | Poirier | F02D 31/001 |
| 11,459,076 | B1 * | 10/2022 | Bielefeld | F16K 31/02 |
| 2022/0048601 | A1 * | 2/2022 | Waldvogel | B63J 3/02 |
| 2023/0028865 | A1 * | 1/2023 | Neathery | B63H 23/28 |

FOREIGN PATENT DOCUMENTS

| | | | |
|---|---|---|---|
| GB | 1530959 | A | 11/1978 |

* cited by examiner

*Primary Examiner* — John Kwon
(74) *Attorney, Agent, or Firm* — Andrus Intellectual Property Law, LLP

(57) ABSTRACT

A method for controlling a marine propulsion device to have sufficient power available within a power system to meet demands, the marine propulsion device having an engine rotatably engaged with a transmission via a clutch. The method includes measuring the power available within the power system and measuring the demand for power on the power system. The method further includes determining a power difference between the demand and the power available within the power system, and comparing the power difference to a minimum threshold. The method further includes increasing a speed of the engine and increasing a slip of the clutch when the power difference is exceeds the minimum threshold.

20 Claims, 5 Drawing Sheets

SYSTEMS AND METHODS FOR CONTROLLING POWER GENERATION AND TRANSMISSION OUTPUT SPEED FOR MARINE PROPULSION DEVICES

CROSS REFERENCE TO RELATED APPLICATIONS

This application is a divisional application of U.S. patent application Ser. No. 16/991,105, filed Aug. 12, 2020, which is incorporated herein by reference in its entirety.

FIELD

The present disclosure relates to systems and methods for controlling power generation and transmission output speed for marine propulsion devices, and particularly to controlling the marine propulsion device such that the transmission output speed is not changed when power generation is changed.

BACKGROUND

GB Patent Application Publication No. 1530959A discloses an automatic change-gear assembly for a water-jet boat propulsion system having an input shaft linked to an output shaft via a one-way clutch and an overdrive system comprising gears meshing with gears on the input and output shafts respectively, the gears being drivingly interconnectible by a fluid actuated multiplate clutch. Clutch is engaged when fluid pressure in a throttled passageway in a layshaft carrying the gears builds up to displace annular piston with gear. Fluid pressure is supplied by a pump when a lubricating by-pass valve is closed by a solenoid. Valve is normally closed at low speeds, and thus drive is effected through the overdrive, the gear change to direct drive taking place in response to one of the following; maximum engine throttle-opening, predetermined engine speed, predetermined boat speed or a manual override, or dis-engagement of the direct-drive by a neutral switch. In a modification there are two overdrives, having different drive ratios, and operative sequentially.

U.S. Pat. No. 6,176,750 discloses an improved hydraulic system for a twin propeller marine propulsion unit. A vertical drive shaft is operably connected to the engine of the propulsion unit and carries a pinion that drives a pair of coaxial bevel gears. An inner propeller shaft and an outer propeller shaft are mounted concentrically in the lower torpedo section of the gear case and each propeller shaft carries a propeller. To provide forward movement for the watercraft, a sliding clutch is moved in one direction to operably connect the first of the bevel gears with the inner propeller shaft to drive the rear propeller. A hydraulically operated multi-disc clutch is actuated when engine speed reaches a pre-selected elevated value to operably connect the second of the bevel gears to the outer propeller shaft, to thereby drive the second propeller in the opposite direction. The hydraulic system for actuating the multi-disc clutch includes a pump connected to the inner propeller shaft, and the pump has an inlet communicating with a fluid reservoir in the gear case and has an outlet which is connected through a hydraulic line to the multi-disc clutch. A strainer, a pressure regulator and a valve mechanism are disposed in the lower gear case and are located in series in the hydraulic line. At idle and slow operating speeds the valve is held by a solenoid in a position where the fluid is dumped to the reservoir, so that the pressure of the fluid being directed to the multi-disc clutch is insufficient to engage the clutch. At engine speeds above a preselected value, the solenoid is de-energized and the valve is then biased to a position where the fluid is delivered to the multi-disc clutch to engage the clutch and cause operation of the second propeller.

U.S. Pat. No. 8,439,800 discloses a shift control system for a marine drive that applies partial clutch engagement pressure upon initial shifting from forward to reverse to prevent stalling of the engine otherwise caused by applying full clutch engagement pressure upon shifting from forward to reverse.

U.S. Pat. No. 9,441,724 discloses a method of monitoring and controlling a transmission in a marine propulsion device comprising the steps of receiving a rotational input speed of an input shaft to the transmission, receiving a rotational output speed of an output shaft from the transmission, receiving a shift actuator position value, and receiving an engine torque value. The method further comprises calculating a speed differential based on the input speed and the output speed, and generating a slip profile based on a range of speed differentials, engine torque values, and shift actuator position values.

U.S. Pat. Nos. 6,342,775, 6,652,330, 6,857,917, 7,812,467, and 9,975,619 provide further background relating to the present disclosure.

The above-noted patents and applications are hereby incorporated by reference herein, in their entireties.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

One embodiment according to the present disclosure generally relates to a method for controlling a marine propulsion device having an engine rotatably engaged with a transmission via a clutch, and rotatably engaged with a charging device for charging a battery. The method includes measuring a voltage of the battery and comparing the voltage to a minimum threshold. The method further includes increasing a speed of the engine when the voltage is below the minimum threshold, and also increasing a slip of the clutch when the speed of the engine is increased in response to the voltage being below the minimum threshold.

Another embodiment according to the present disclosure generally relates to a marine propulsion device configured to propel a marine vessel through water, where the marine vessel includes a battery and a voltage sensor that measures a voltage of the battery. The marine propulsion device includes an engine and a transmission rotatably coupled to the engine via a clutch. A charging device is rotatably coupled to the engine and configured to charge the battery within the marine vessel. A control system monitors the voltage of the battery measured by the voltage sensor and compares the voltage to a minimum threshold. The control system is configured to increase a speed of the engine when the voltage is below the minimum threshold, and to increase a slip of the clutch when the speed of the engine is increased in response to the voltage being below the minimum threshold.

Another embodiment according to the present disclosure generally relates to a method for controlling a marine propulsion device to have sufficient power available within a power system to meet demands, where the marine propulsion device has an engine rotatably engaged with a transmission via a clutch. The method includes measuring the power available within the power system, and measuring the demand for power on the power system. The method further includes determining a power difference between the power available within the power system and the demand, and comparing the power difference to a minimum threshold. The method further includes increasing a speed of the engine and also increasing a slip of the clutch when the power difference is below the minimum threshold.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity, and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible.

Figure 1:
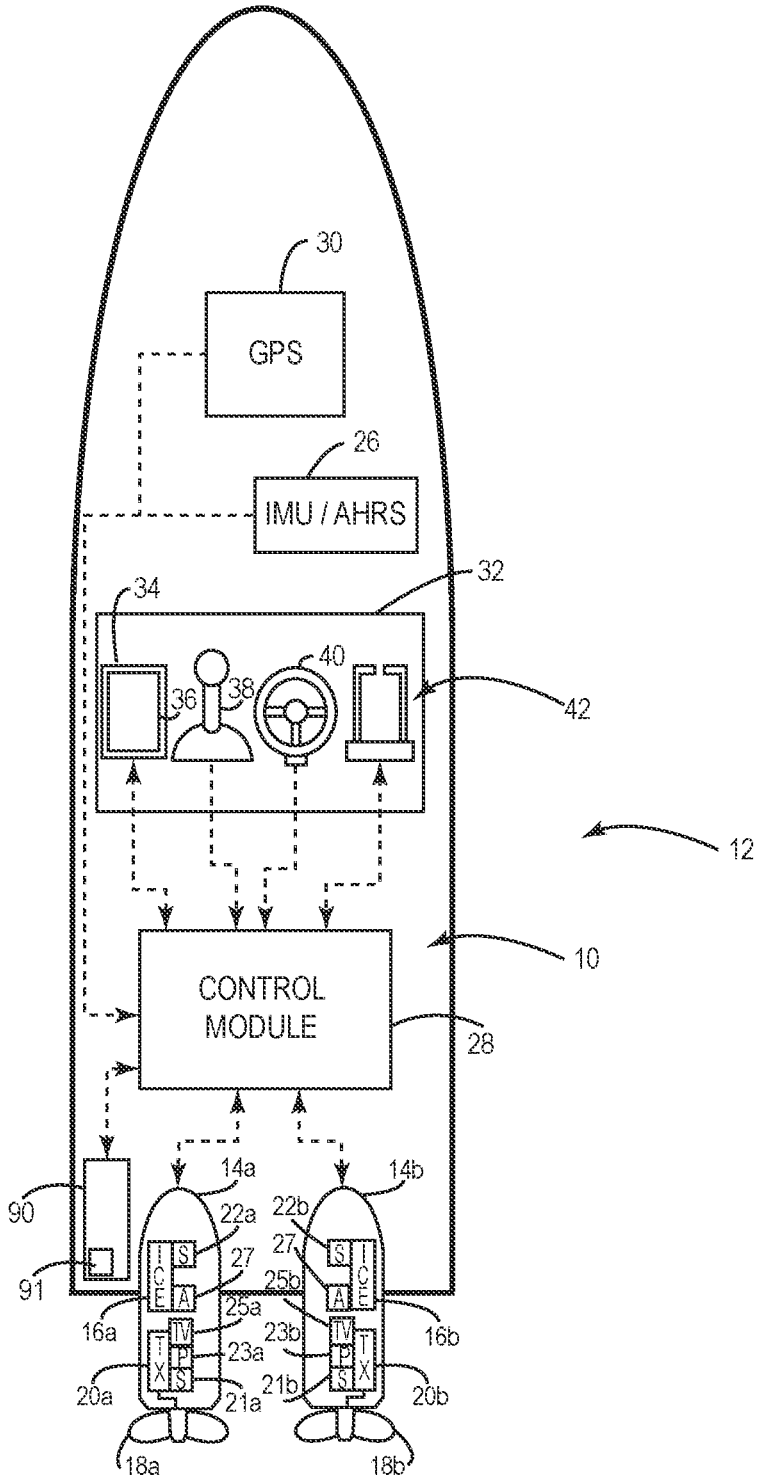
FIG. 1 illustrates one example of a marine vessel including a marine propulsion system according to the present disclosure.

FIG. 1 illustrates a marine propulsion system 10 for a marine vessel 12. The marine propulsion system 10 includes two marine propulsion devices 14*a*, 14*b*, but one or more than two marine propulsion devices could instead be provided. The marine propulsion devices 14*a*, 14*b* shown herein are outboard motors, but the marine propulsion devices could instead be inboard motors, stern drives, pod drives, jet drives, etc. Each marine propulsion device 14*a*, 14*b* includes an engine 16*a* or 16*b*. The engines 16*a*, 16*b* shown here are internal combustion engines, which may be, for example, gasoline or diesel engines. Each marine propulsion device 14*a*, 14*b* also includes a propeller 18*a* or 18*b* configured to be coupled in torque-transmitting relationship with a respective engine 16*a* or 16*b*. Such torque-transmitting relationship is more specifically provided by way of a transmission 20*a* or 20*b* configured to transmit torque from a respective engine 16*a* or 16*b* to a respective propeller 18*a* or 18*b*. As will described further herein below with respect to FIG. 2, each transmission 20*a*, 20*b* is configured to transmit torque from the engine 16*a* or 16*b* to the propeller 18*a* or 18*b* at one of at least a first gear ratio and a second gear ratio, although additional gear ratios such as, for example, third, fourth, fifth, etc. gear ratios could be provided. Alternatively, only a single forward gear ratio may be provided.

The marine propulsion system 10 further includes engine speed sensors 22*a*, 22*b* measuring a speed of a respective engine 16*a*, 16*b*. In one example, the engine speed sensors 22*a*, 22*b* may be shaft rotational speed sensors (e.g., Hall-Effect sensors), which measure a speed of the engine 16*a* or 16*b* in rotations per minute (RPM), as is known to those having ordinary skill in the art. The engine speed is also referenced to as a transmission input speed, as the input shaft of a transmission in certain embodiments is coupled to rotate directly therewith. Each transmission 20*a*, 20*b* includes a transmission output speed (TOS) sensor 21*a*, 21*b* that measures a transmission output speed of the respective transmission 20*a*, 20*b* in RPM. The TOS sensors 21*a*, 21*b* may be of a type similar to that of the engine speed sensors 22*a*, 22*b*. Clutch pressure sensors 23*a*, 23*b* are also provided in connection with the transmissions 20*a*, 20*b*. Clutch pressure sensors 23*a*, 23*b* can be pressure transducers in the hydraulic circuit(s) associated with the clutches of the transmissions 20*a*, 20*b*. Trolling valves 25*a*, 25*b* are also provided for each marine propulsion device 14*a*, 14*b*, and will be described further herein below.

The marine propulsion system 10 also includes a control module 28 in signal communication with the engines 16*a*, 16*b* and the transmissions 20*a*, 20*b*, as well as their associated sensors and valves and other components noted herein below. The control module 28 may also be configured to control the flow of power between components in the marine vessel 12. Among these components is a power system 90, which in certain embodiments includes batteries 91 and/or other energy storage systems in a manner known in the art. The power system 90 of certain embodiments also includes power management and protection circuitry, such as that discussed in the U.S. patents referenced in the Background section, for example.

In the exemplary embodiment of FIG. 1, an alternator 27 provided with the marine propulsion devices 14*a*, 14*b* generates power via rotation of the engines 16*a*, 16*b* in a manner known in the art. These alternators 27 generate and provide power to the power system 90, such as to charge the batteries 91 or to aid in powering any power consuming devices connected thereto. It will be recognized that the batteries 91 may also or alternatively be charged by other charging devices, such as a stator, for example.

The control module 28 is programmable and includes a processor and a memory. The control module 28 can be located anywhere in the marine propulsion system 10 and/or located remote from the marine propulsion system 10 and can communicate with various components of the marine vessel 12 via a peripheral interface and wired and/or wireless links, as will be explained further herein below. Although FIG. 1 shows one control module 28, the marine propulsion system 10 can include more than one control module. Portions of the method disclosed herein below can be carried out by a single control module or by several separate control modules. For example, the marine propulsion system 10 can have control modules located at or near a helm 32 of the marine vessel 12 and can also have control module(s) located at or near the marine propulsion devices 14*a*, 14*b*. If more than one control module is provided, each can control operation of a specific device or sub-system on the marine vessel.

In some examples, the control module 28 may include a computing system that includes a processing system, storage system, software, and input/output (I/O) interfaces for communicating with peripheral devices. The systems may be implemented in hardware and/or software that carries out a programmed set of instructions. As used herein, the term "control module" may refer to, be part of, or include an application specific integrated circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip (SoC). A control module may include memory (shared, dedicated, or group) that stores code executed by the processing system. The term "code" may include software, firmware, and/or microcode, and may refer to programs, routines, functions, classes, and/or objects. The term "shared" means that some or all code from multiple control modules may be executed using a single (shared) processor. In addition, some or all code from multiple control modules may be stored by a single (shared) memory. The term "group" means that some or all code from a single control module may be executed using a group of processors. In addition, some or all code from a single control module may be stored using a group of memories.

The control module 28 communicates with one or more components of the marine propulsion system 10 via the I/O interfaces and a communication link, which can be a wired or wireless link. In one example, the communication link is a controller area network (CAN) bus, but other types of links could be used. It should be noted that the extent of connections of the communication link shown herein is for schematic purposes only, and the communication link in fact provides communication between the control module 28 and each of the peripheral devices noted herein, although not every connection is shown in the drawing for purposes of clarity.

Figure 3:
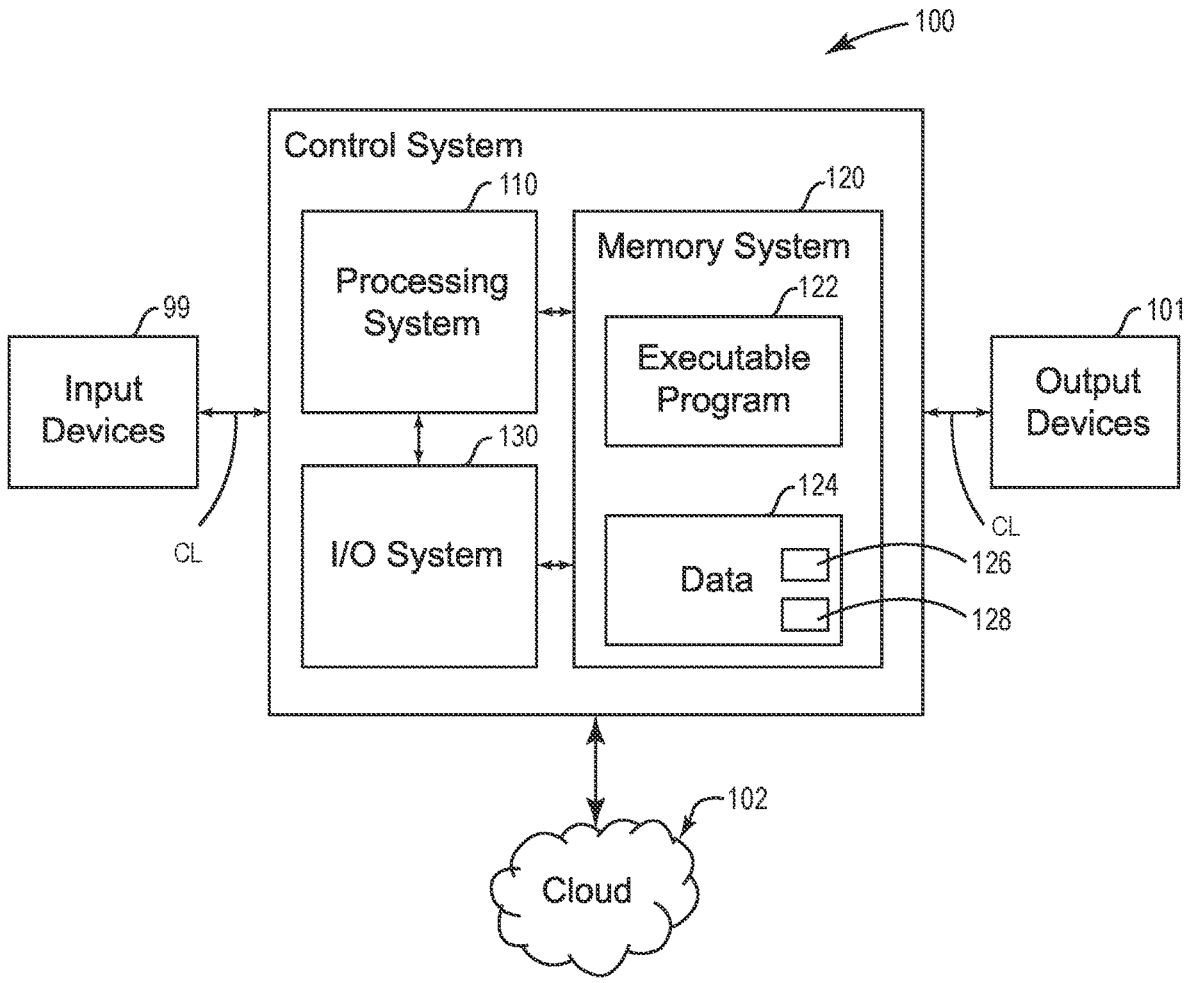
FIG. 3 is a schematic view of an exemplary control system for controlling transmission valves according to the present disclosure.

An exemplary control system 100 is shown in FIG. 3, which can be used as the control module 28 discussed above. Certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, lookup tables, or the like, configured to carry out a variety of functions under the control of one or more processors or other control devices. The connections between functional and logical block components are merely exemplary, which may be direct or indirect, and may follow alternate pathways.

In certain examples, the control system 100 communicates with each of the one or more components of the marine propulsion system 10 via a communication link CL, which can be any wired or wireless link. The control module 100 is capable of receiving information and/or controlling one or more operational characteristics of the marine propulsion system 10 and its various sub-systems by sending and receiving control signals via the communication links CL. In one example, the communication link CL is a controller area network (CAN) bus; however, other types of links could be used. It will be recognized that the extent of connections and the communication links CL may in fact be one or more shared connections, or links, among some or all of the components in the marine propulsion system 10. Moreover, the communication link CL lines are meant only to demonstrate that the various control elements are capable of communicating with one another, and do not represent actual wiring connections between the various elements, nor do they represent the only paths of communication between the elements. Additionally, the marine propulsion system 10 may incorporate various types of communication devices and systems, and thus the illustrated communication links CL may in fact represent various different types of wireless and/or wired data communication systems.

The control system 100 may be a computing system that includes a processing system 110, memory system 120, and input/output (I/O) system 130 for communicating with other devices, such as input devices 99 and output devices 101, either of which may also or alternatively be stored in a cloud 102. The processing system 110 loads and executes an executable program 122 from the memory system 120, accesses data 124 stored within the memory system 120, and directs the marine propulsion system 10 to operate as described in further detail below.

The processing system 110 may be implemented as a single microprocessor or other circuitry, or be distributed across multiple processing devices or sub-systems that cooperate to execute the executable program 122 from the memory system 120. Non-limiting examples of the processing system include general purpose central processing units, application specific processors, and logic devices.

The memory system 120 may comprise any storage media readable by the processing system 110 and capable of storing the executable program 122 and/or data 124. The memory system 120 may be implemented as a single storage device, or be distributed across multiple storage devices or sub-systems that cooperate to store computer readable instructions, data structures, program modules, or other data. The memory system 120 may include volatile and/or non-volatile systems, and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example.

Returning to FIG. 1, the marine propulsion system 10 also includes a global positioning system (GPS) 30 that provides location and speed of the marine vessel 12 to the control module 28. Additionally or alternatively, a vessel speed sensor such as a Pitot tube or a paddle wheel could be provided. The marine propulsion system 10 may also include an inertial measurement unit (IMU) or an attitude and heading reference system (AHRS) 26. An IMU has a solid state, rate gyro electronic compass that indicates the vessel heading and solid state accelerometers and angular rate sensors that sense the vessel's attitude and rate of turn. An AHRS provides 3D orientation of the marine vessel 12 by integrating gyroscopic measurements, accelerometer data, and magnetometer data. The IMU/AHRS could be GPS-enabled, in which case a separate GPS 30 would not be required.

Further, the marine propulsion system 10 includes a number of operator input devices located at the helm 32 of the marine vessel 12. The operator input devices include a multi-functional display device 34 including a user interface 36. The user interface 36 may be an interactive, touch-capable display screen, a keypad, a display screen and keypad combination, a track ball and display screen combination, or any other type of user interface known to those having ordinary skill in the art for communicating with a multi-functional display device 34. A joystick 38 is also provided at the helm 32 and allows an operator of the marine vessel 12 to command the marine vessel 12 to translate or rotate in any number of directions. A steering wheel 40 is provided for providing steering commands to the marine propulsion devices 14*a*, 14*b* or to a rudder, in the event that the marine propulsion devices are not steerable. A throttle lever 42 is also provided for providing thrust commands, including both a magnitude and a direction of thrust, to the control module 28. Here, two throttle levers are shown, each of which can be used to control one of the marine propulsion devices 14*a* or 14*b*, although the two levers can be controlled together as a single lever. Alternatively, a single lever could be provided for controlling both marine propulsion devices 14*a*, 14*b*.

Several of the operator input devices at the helm 32 can be used to input an operator demand on the engines 16*a*, 16*b* to the control module 28, including the user interface 36 of the multi-functional display device 34, the joystick 38, and the throttle lever 42. By way of example, a rotation of the throttle lever 42 in a forward direction away from its neutral, detent position could be interpreted as a value from 0% to 100% operator demand corresponding via an input/output map, such as a look up table, to a position of the throttle valves of the engines 16*a*, 16*b*. For example, the input/output map might dictate that the throttle valves are fully closed when the throttle lever 42 is in the forward, detent position (i.e., 0% demand), and are fully open when the throttle lever 42 is pushed forward to its furthest extent (i.e., 100% demand).

Figure 2:
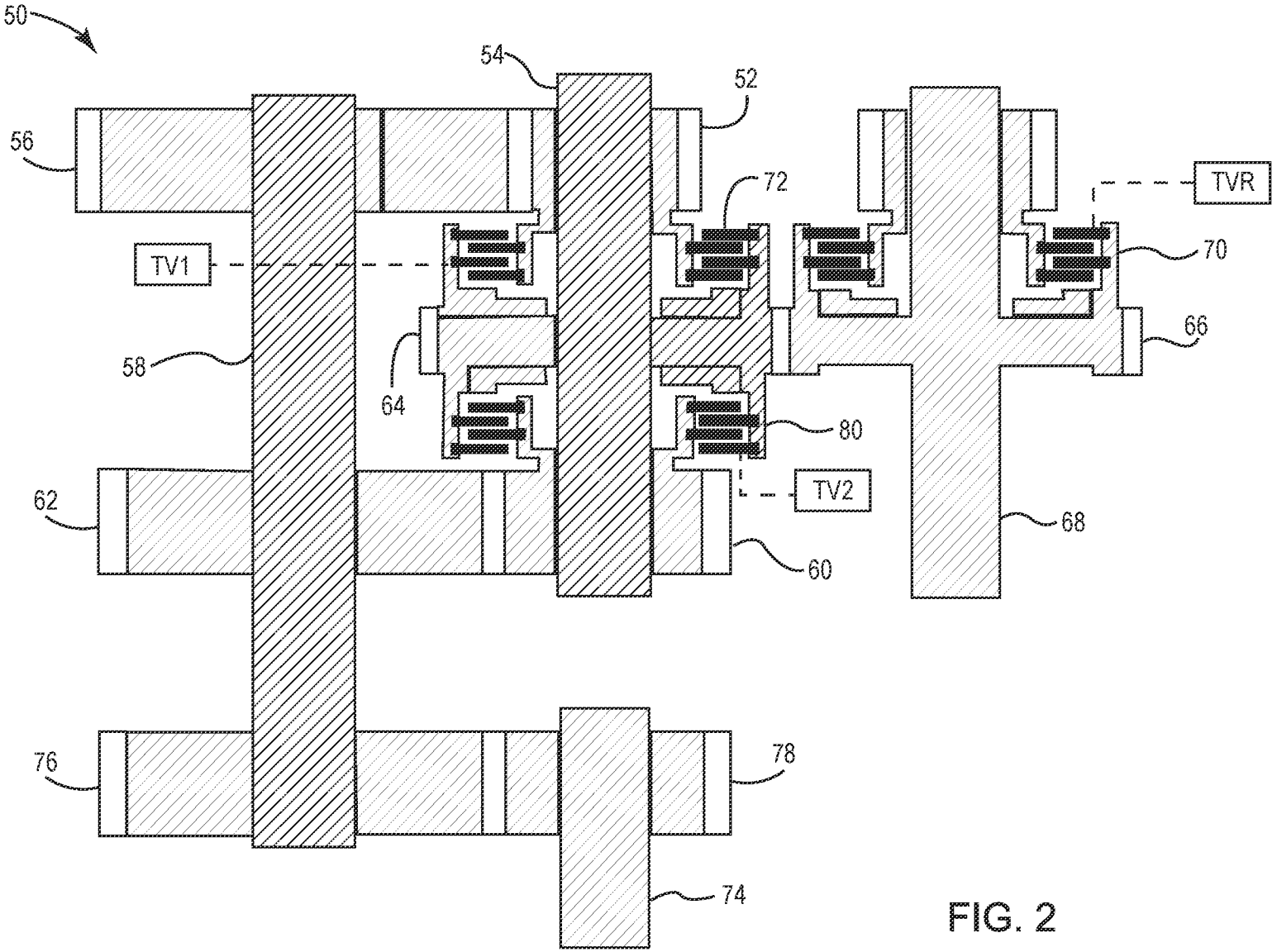
FIG. 2 is a schematic illustrating one example of a transmission for an engine powering a marine propulsion device according to the present disclosure.

One schematic example of a multi-speed transmission 50 (i.e., transmission 20*a* or 20*b*) is shown in FIG. 2. The transmission 50 shown herein is a two-speed layshaft transmission, but other transmissions, such as epicyclic (planetary), dual-clutch, continuously variable, or of other known type could be used. The transmission 50 shown herein has two gear ratios, provided by a first input gear 52 on input shaft 54 (which is coupled to an output shaft of the engine 16*a* or 16*b*, as is known) and a first counter gear 56 on countershaft 58, and by a second input gear 60 and a second counter gear 62. Alternatively, fewer or more than two forward gear ratios could be provided. A reverse gear 64 is also provided on input shaft 54, and meshes with reverse gear 66 on reverse shaft 68, but will not be described further herein, other than to say reverse rotation of the propeller 18*a* or 18*b* is accomplished by way of actuating reverse clutch 70.

A first-gear clutch 72 is provided for placing the transmission 50 in first gear, such that first input gear 52 and first counter gear 56 transmit torque to output shaft 74 via output counter gear 76 and output gear 78 at a first gear ratio. A second-gear clutch 80 is provided for placing the transmission 50 in second gear, such that second input gear 60 and second counter gear 62 transmit torque to output shaft 74 via output counter gear 76 and output gear 78 at a second gear ratio. In one example, the first gear ratio is higher than the second gear ratio. Thus, when the transmission 50 transmits torque from the engine 16*a* or 16*b*, via the input shaft 54, the first gears 52, 56, the output gears 76, 78, and the output shaft 74 to the propeller 18*a* or 18*b* (via a propeller shaft) the transmission 50 provides more torque and less speed than it would provide were it to be placed in second gear, engine input speed being equal. For simplicity, engagement within any of the gears will also be referred to herein as being "in gear". Note that the clutches 70, 72, 80 shown herein are multi-plate wet disc clutches, and each is provided with a trolling valve TV1, TV2, TVR (i.e., trolling valve 25*a*, 25*b*).

In inboard motors, for example, it is known to couple a trolling valve to a forward clutch and a reverse clutch in a marine engine's transmission. The forward and reverse clutches engage forward and reverse gears, respectively, via pressure plates of a wet clutch. One example of such a system is described in U.S. Pat. No. 8,439,800, which was incorporated by reference herein above. The amount of engagement of the clutches with the gears can optionally be controlled by the trolling valves, where engagement can range from not engaged (100% slip) to fully engaged (0% slip). Control over slip results in control over the resulting speed of the propeller on the marine propulsion device, as more or less rotational power from the output shaft of the engine is transmitted to the forward or reverse gear, which in turn provides more or less torque to the propeller shaft. Therefore, a higher percentage of slip leads to lower propeller speeds (and thus lower boat speeds), and a lower percentage of slip leads to higher propeller speeds (and thus higher boat speeds).

The trolling valves TV1, TV2, TVR may be configured to receive control signals from the control module 28 and responsively control an amount of hydraulic fluid to the clutches 70, 72, 80, thus controlling the amount of engagement of the clutches 70, 72, 80 with their respective gears 66, 52, 60. Although the valves are referred to as "trolling" valves, thus implying a specific application on marine vessels for trolling operations, the valves TV1, TV2, TVR may be used in any of a variety of other applications for the purpose of controlling an amount of hydraulic fluid to the clutches 70, 72, 80. For example, as will be discussed herein below, the trolling valves TV1, TV2, TVR can be used in order to carry out a method for enhancing launch of the marine vessel 12.

The inventors have identified issues with respect to power management systems for marine propulsion systems presently known in the art, and particularly the manner in which additional power is generated when needed. In particular, the power generated by the marine propulsion devices 14*a*, 14*b* via the alternators 27 operatively coupled thereto is a function of the speed that each of the engines 16*a*, 16*b* runs. The faster the engines 16*a*, 16*b* run, the more power is generated via the alternators 27. The inventors have identified that when the marine vessel 12 is operated at trolling speed, which typically corresponds to a low speed for the engines 16*a*, 16*b*, the demand of various accessories consuming electrical power frequently exceed the power generated by the alternators 27. In this state, the power system 90 operates at a deficit and the energy storage units, such as batteries 91, are drained.

Battery charging strategies presently known in the art address this condition by increasing the operating speed of the engines 16*a*, 16*b*, whenever the battery voltage 91 is determined to fall below a minimum threshold, such as 11.5 volts, for example. By increasing the speed of the engines 16*a*, 16*b*, additional power is produced by the alternators 27 to address the power deficit and recharge the batteries. However, the inventors have identified that increasing the engine speed in order to produce this additional power also has the undesired effect of increasing the speed of the marine vessel 12. In other words, in addition to providing the increase in rotational speed for the alternators 27, increasing the speed of the engines 16*a*, 16*b* also increases the speed of the transmission output shafts of the transmissions 20*a*, 20*b*, consequently increasing the rotational speeds of the propellers 18*a*, 18*b*. Since the operator of the marine vessel 12 had previously selected the desired speed for the marine vessel 12 via controls at the helm 32, such as via the throttle lever 42, this increase is undesirable.

Accordingly, the inventors have developed the presently disclosed systems and methods for controlling a marine propulsion device 14*a*, 14*b* to provide the power generation required by the power system 90, without impacting the speed of the marine vessel 12. In particular, the inventors have recognized that by controlling the slip percentage of the transmissions using trolling valves as discussed above, it is possible to counteract the increased speed of the engine necessary to increase power generation by the alternator 27, consequently preventing an increase in the marine vessel 12 speed.

Figure 4:
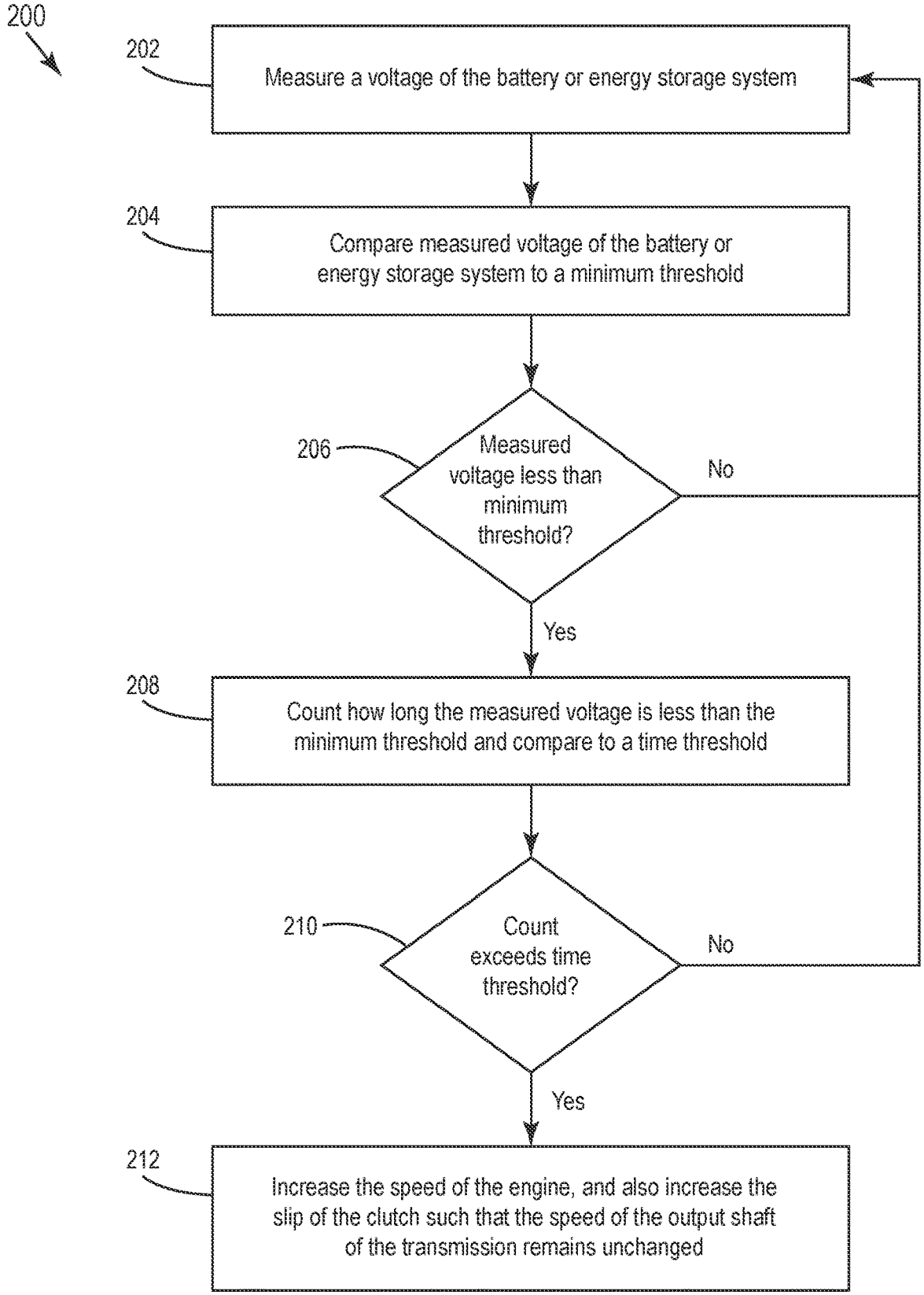
FIG. 4 is a process flow of an exemplary method for controlling a marine propulsion device according to the present disclosure.

In the exemplary method 200 of FIG. 4, the process begins with measuring a voltage of the battery 91 (FIG. 1) or energy storage system in step 202, which may be performed via conventional methods and through conventional sensors. In step 204, the voltage measured in step 202 is compared to a minimum threshold, such as may be stored within a thresholds module 128 stored as data 124 within the memory system 120 previously discussed above with respect to FIG. 3. If in step 206 it is determined that the measured voltage is not less than the minimum threshold, the process continues with measuring voltages back at step 202. If alternatively it is determined in step 206 that the measured voltage is in fact less than the minimum threshold, the process continues to step 208, which counts how long the measured voltage is less than this minimum threshold, and compares this duration to a time threshold. The time threshold may also be stored within the threshold module 128 previously discussed, which can be any number zero and above. If in step 210 it is determined that the count does not yet exceed the time threshold, the process returns until such time that the count does exceed the time threshold.

Once the count does exceed the time threshold as determined in step 210, the process continues to step 212, at which point the speed of the engine is increased, while concurrently also increasing the slip of the clutch. The consequence of increasing the slip of the clutch when increasing the speed of the engine is that the speed of the output shaft for the transmission remains unchanged, as less of the engines rotational speed is transmitted through the transmission. Consequently, the power generated by the alternator 27 is increased in response to the measured voltage being less than the minimum threshold, while nonetheless maintaining a consistent speed of the marine vessel 12.

In certain embodiments, the engine speed and/or slip of the clutch are selected using a lookup table 126 stored within the memory system 120. The engine speed and slip percentage may be provided as functions of each other, and/or as a function of the measured voltage of the batteries 91.

Figure 5:
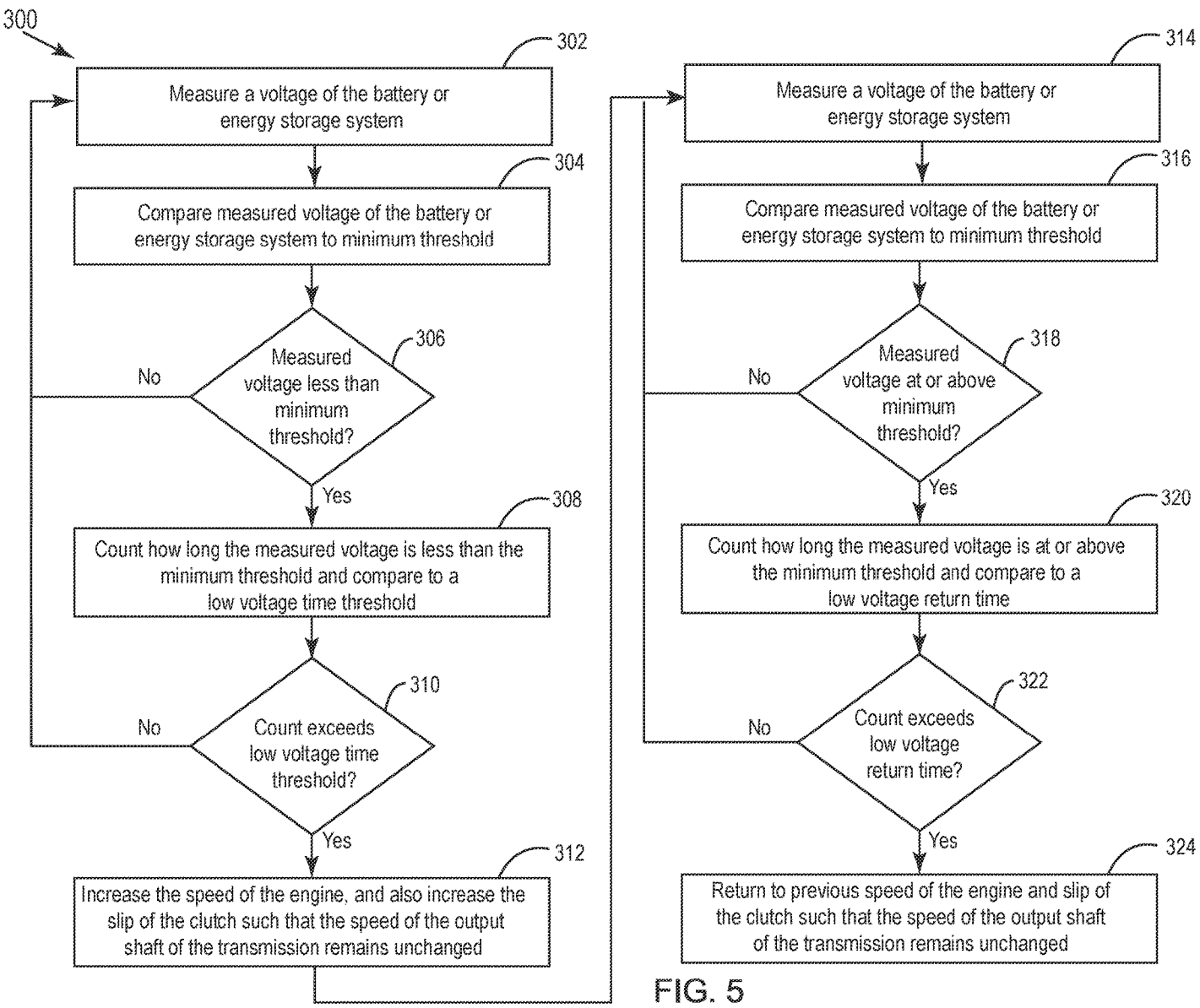
FIG. 5 is a process flow of an exemplary method for controlling a marine propulsion device according to the present disclosure.

Another exemplary process 300 is disclosed in FIG. 5. The process 300 begins with step 302, which like step 202 previously discussed measures the voltage of the battery 91 or energy system in a conventionally known manner. In step 304, the measured voltage is then compared to a minimum threshold, which may be stored within the thresholds module 128 of the memory system 120 as previously discussed. It is then determined in step 306 whether the measured voltage is less than the minimum threshold. If so, the system proceeds to step 308, which counts how long the measured voltage is less than the minimum threshold and compares this count to a low voltage time threshold, which may also be stored within the threshold module 128 which may be any number zero and above. If it is determined in step 310 that the count does not yet exceed the low voltage time threshold, the process continues. If instead the count does exceed the low voltage time threshold, the speed of the engine and slip of the clutch are both increased in step 312, which results in increased power generation by the alternator 27 without changing the speed of the output shaft for the transmission.

As discussed above, these adjustments may be based on the lookup table 126, for example. The process 300 then proceeds to step 314, which again measures the voltage of the battery for comparison in step 316 to a minimum threshold, which may be the same or different than the minimum threshold of step 304. The process repeats at step 314 if the minimum threshold is not exceeded by the measured voltage as determined in step 318. Once the minimum threshold is met or exceeded, step 320 provides for counting how long the minimum threshold is met or exceeded, which is compared to low voltage return time started in the threshold module 128. This delay ensures that the low voltage condition has truly cleared, and also prevents the speed of the engine from being changed overly frequently, which might be objectionable to the operator and detract from an overall seamless power management system.

Once the low voltage return time has been determined to have passed in step 322, the engine speed may again be reduced and the clutch slip corresponding reduced as well. It will be recognized that the engine speed and slip percentage may be returned to original values, to the new set points, or be set based on current voltage measurements and/or power demands on the power system 90, for example.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

In the present description, certain terms have been used for brevity, clarity, and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible within the scope of the appended claims.

What is claimed is:

1. A method for controlling a marine propulsion device to have sufficient power available within a power system to meet demands, the marine propulsion device having an engine rotatably engaged with a transmission via a clutch, the method comprising:

measuring the power available within the power system;

measuring the demand for power on the power system;

determining a power difference between the demand and the power available within the power system, and comparing the power difference to a minimum threshold; and increasing a speed of the engine and increasing a slip of the clutch when the power difference exceeds the minimum threshold.

2. The method according to claim 1, further comprising accessing a lookup table to determine how much to increase the speed of the engine.

3. The method according to claim 1, further comprising accessing a lookup table to determine how much to increase the slip of the clutch.

4. The method according to claim 1, further comprising accessing a lookup table to determine how much to increase the slip of the clutch as a function of how much the speed of the engine is increased.

5. The method according to claim 1, further comprising measuring an input speed of the transmission, and incorporating the measurement of the input speed into determining how much to increase the speed of the engine when the power difference exceeds the minimum threshold.

6. The method according to claim 1, further comprising measuring an output speed of the transmission and using the output speed to determine how much to increase the slip of the clutch.

7. The method according to claim 1, wherein the power system includes a battery, further comprising controlling the marine propulsion device such that when a voltage of the battery is a first voltage the slip of the clutch is set to a first percentage and an output speed of the transmission is a first speed, and such that when the voltage of the battery is a second voltage different than the first voltage the slip of the clutch is set to a second percentage that is different than the first percentage and the output speed of the transmission is a second speed that is substantially equal to the first speed.

8. The method according to claim 1, wherein the clutch is a wet clutch.

9. The method according to claim 1, wherein the transmission is a multi-speed transmission engageable by the clutch.

10. The method according to claim 1, wherein the power system includes a battery, further comprising comparing a voltage measured for the battery to a maximum threshold, and further comprising decreasing the speed of the engine and decreasing the slip of the clutch when the voltage is above the maximum threshold.

11. A marine propulsion device configured to propel a marine vessel through water, the marine vessel having a power system configured to provide power to meet a demand for power, the marine propulsion device comprising:

an engine;

a transmission rotatably coupled to the engine via a clutch;

a charging device rotatably coupled to the engine and configured to generate power; and a control system configured to measure the power available within the power system, to measure the demand for power, and to determine a power difference therebetween, the control system being further configured to increase a speed of the engine and a slip of the clutch when the power difference exceeds a minimum threshold to thereby provide that the power available is sufficient to meet the demand for power.

12. The marine propulsion device according to claim 11, wherein the charging device is an alternator.

13. The marine propulsion device according to claim 11, further comprising a memory system accessible by the control system, wherein the memory system stores a lookup table incorporating values for determining how much to increase the speed of the engine.

14. The marine propulsion device according to claim 11, further comprising a memory system accessible by the control system, wherein the memory system stores a lookup table incorporating values for determining how much to increase the slip of the clutch.

15. The marine propulsion device according to claim 11, further comprising a memory system accessible by the control system, wherein the memory system stores a lookup table incorporating values for the slip of the clutch relative to the speed of the engine, and wherein the control system references the lookup table to determine how much to increase the slip of the clutch.

16. The marine propulsion device according to claim 11, further comprising a transmission output speed sensor configured to measure an output speed of the transmission, wherein the control system monitors the output speed to determine how much to increase the slip of the clutch.

17. The marine propulsion device according to claim 11, further comprising a transmission input speed sensor configured to measure an input speed of the transmission, wherein the control system monitors the input speed to determine how much to increase the speed of the engine.

18. The marine propulsion device according to claim 11, wherein the power system includes a battery, and wherein the control system is further configured to compare a voltage measured for the battery to a maximum threshold, and to decrease the speed of the engine and also decrease the slip of the clutch when the voltage is above the maximum threshold.

19. The marine propulsion device according to claim 11, wherein the power system includes a battery, wherein the control system is configured to control the marine propulsion device such that when a voltage of the battery is a first voltage the slip of the clutch is set to a first percentage and an output speed of the transmission is a first speed, and wherein when the voltage of the battery is a second voltage different than the first voltage the slip of the clutch is set to a second percentage that is different than the first percentage and the output speed of the transmission is a second speed that is substantially equal to the first speed.

20. A marine vessel incorporating the marine propulsion device controlled according to claim 11.

* * * * *